US005755477A

United States Patent [19]

McKnight

[11] Patent Number: 5,755,477

[45] Date of Patent: May 26, 1998

[54] TOTE DEVICE

[76] Inventor: Kevin J. McKnight, 129 Grandview Rd., Springfield, Pa. 19064

[21] Appl. No.: 613,223

[22] Filed: Mar. 8, 1996

[51] Int. Cl.[6] ..... B65D 71/00

[52] U.S. Cl. ..... 294/146; 294/159

[58] Field of Search ..... 294/141–143, 294/146–148, 159, 161–166, 170; 206/315.2, 315.11, 443; 211/60.1, 62, 70.2, 70.8; 224/915, 922

[56] References Cited

U.S. PATENT DOCUMENTS

| | | | |
|---|---|---|---|
| D. 330,620 | 10/1992 | Frey | D34/28 |
| D. 337,445 | 7/1993 | Sando | D6/368 |
| 1,005,235 | 10/1911 | Langguth | 294/148 X |
| 1,208,488 | 12/1916 | Coleman | 135/25.4 |
| 1,696,062 | 12/1928 | Thurlow et al. | 294/143 X |
| 2,024,484 | 12/1935 | Smith | 294/159 X |
| 2,791,255 | 5/1957 | Ogden | 294/146 X |
| 2,990,865 | 7/1961 | Steele | 294/146 X |
| 3,172,585 | 3/1965 | Mahaney et al. | 294/146 X |
| 3,215,181 | 11/1965 | Reed | 294/146 X |
| 3,693,993 | 9/1972 | Mazzarelli | 280/30 |
| 3,744,502 | 7/1973 | Weber | 135/20 |
| 4,221,313 | 9/1980 | Stowe | 294/141 |
| 4,628,628 | 12/1986 | Burgin et al. | 294/146 X |
| 4,856,912 | 8/1989 | Damus | 383/4 |
| 4,907,614 | 3/1990 | Stamm | 135/20 |
| 5,222,748 | 6/1993 | Johnson | 280/8 |
| 5,362,079 | 11/1994 | Graham | 280/47.2 |

*Primary Examiner*—Johnny D. Cherry
*Attorney, Agent, or Firm*—LaMorte & Associates

[57] ABSTRACT

A tote device for carrying equipment and accessories to and from recreational areas such as the beach. The tote device contains at least one sleeve element that defines an open central region. A handle element is coupled to each sleeve element present and provides an element for carrying each sleeve element. The open central region defined by each sleeve element is sized to receive a large piece of equipment such as a folded beach umbrella or the like. On the exterior of each sleeve element is disposed a plurality of spring clamps sized to selectively receive and engage cylindrical objects, such as the tubular framing of beach chairs, umbrella poles, fishing poles, bag handles or similar items. By placing a large object, such as a beach umbrella, in the center of the tote device and attaching other bulky items, such as bags, poles and chairs to the exterior of the tote device, an element is provided for carrying a large number of bulky items in a space efficient and ergonomically efficient manner.

11 Claims, 5 Drawing Sheets

TOTE DEVICE

BACKGROUND OF THE INVENTION

1. Field of the Invention

The present invention relates to tote devices adapted to receive and carry accessory items commonly used at the beach, such as beach chairs, umbrellas, poles and the like. More particularly, the present invention relates to portable devices with handles that contain a variety of different sized attachment elements that are designed to engage the tubular framing of foldable beach chairs or other tubular structures such as umbrella poles, bag handles and the like.

2. Prior Art Statement

When people travel to the beach, a lake or other recreational location, they often take a large number of accessories intended to make the visit more pleasurable. For example, when people visit the beach, they often take folding chairs, umbrellas, coolers, buckets, shovels, blankets, fishing poles and bags filled with smaller items such as sun screen and a change of clothing. In many instances, a person visiting the beach is unable to drive his/her vehicle directly onto the beach. Similarly, many people visiting the beach stay at hotels that are not directly on the beach. As a consequence, people traveling to the beach are required to physically carry all the accessories they require to the beach. Often the number of accessories is too great for a single trip, so a person must make multiple trips to and from the beach in order to transport all the needed accessories. This problem is compounded for people who have small children. Small children require many extra accessories such as playpens, toys, diaper bags and swimming safety gear, all of which must also be carried to and from the beach.

In the prior art, there have been many devices developed over the years that are specifically intended to alleviate the burden of carrying a large number of accessories to and from the beach. One prior art approach has been to provide a wheeled vehicle, like a wheelbarrow, that can be loaded with gear and pushed or pulled to the beach. Such prior art devices are exemplified by U.S. Pat. No. 3,693,993 to Mazzarelli et al., entitled BEACH TOTE CART and U.S. Pat. No. 5,362,079 to Graham, entitled BEACH CADDY. Some of the problems associated with such prior art devices are that such devices are expensive, bulky and labor intensive to manufacture. Often people traveling to the beach or another recreational location have packed their vehicles to capacity and have no extra room for a large bulky wheeled cart.

Another approach used in the prior art is to provide multi-functional accessories that serve a specific function and then convert into a tote device to help carry other accessories. Examples of such prior art devices are exemplified in U.S. Pat. No. 4,856,912 to Damus et al., entitled COMBINATION BEACH TOWEL AND TOTE BAG and U.S. Pat. No. Des. 337,445 to Sando entitled FOLDABLE BEACH CHAIR AND ACCESSORY TOTE. As can be ascertained from the titles of these patents, the Damus et al. patent discloses a beach towel that converts into a bag and the Sando patent discloses a beach chair that converts into a bag. The problem associated with these types of prior art devices is that their carrying capacity is limited. Furthermore, such prior art devices are incapable of carrying items larger than the tote itself, such as beach umbrellas, folding chairs and the like.

Yet another prior art approach has been the use of multi-pocketed saddlebag totes such as that exemplified in U.S. Pat. No. Des. 330,620 to Frey, entitled CARRIER FOR FOLDING CHAIRS AND ACCESSORIES. In such a prior art device, small accessories are placed in pockets. Large accessories, such as folding chairs, are placed in the center of the tote. The tote is then grasped on either side of the large accessories. The problem associated with such a prior art tote is its limited carrying capacity and the lack of any positive engagement of the large accessories being supported by the tote. For instance, if an umbrella were placed in the tote, it would extend from the front end and back end of the tote. The umbrella could therefore easily fall out of the tote as the tote is carried and manipulated on the way to the beach.

It is therefore an objective of the present invention to provide a device capable of assisting in the carrying of large accessories to and from a recreational area in a manner that firmly secures the accessories being carried.

It is a further objective of the present invention to provide a carrying device for carrying accessories to a recreational area that is small, lightweight, easy to use and inexpensive to manufacture.

SUMMARY OF THE INVENTION

The present invention is a tote device for carrying equipment and accessories to and from recreational areas such as the beach. The tote device contains at least one sleeve element that defines an open central region. A handle element is coupled to each sleeve element present and provides a means for carrying each sleeve element in a fixed orientation. The open central region defined by each sleeve element is sized to receive a large piece of equipment such as a folded beach umbrella or the like. On the exterior of each sleeve element is disposed a plurality of spring clamps sized to selectively receive and engage cylindrical objects, such as the tubular framing of beach chairs, umbrella poles, fishing poles, bag handles, cooler handles or similar items. By placing a large object, such as a beach umbrella, in the center of the tote device and attaching other bulky items, such as bags, poles and chairs to the exterior of the tote device, a means is provided for carrying a large number of bulky items in a space efficient and ergonomically efficient manner.

BRIEF DESCRIPTION OF THE DRAWINGS

For a better understanding of the present invention, reference is made to the following description of three exemplary embodiments thereof, considered in conjunction with the accompanying drawings, in which.

DETAILED DESCRIPTION OF THE INVENTION

Although the present invention tote device can be used to carry a large variety of accessories and equipment, such as camping equipment, hunting equipment, ski equipment and the like, the present invention tote device is especially well suited for carrying beach related equipment and accessories. As such, the present invention tote device will be described in an application with beach equipment and accessories in order to set forth the best mode contemplated for the present invention.

Figure 1:
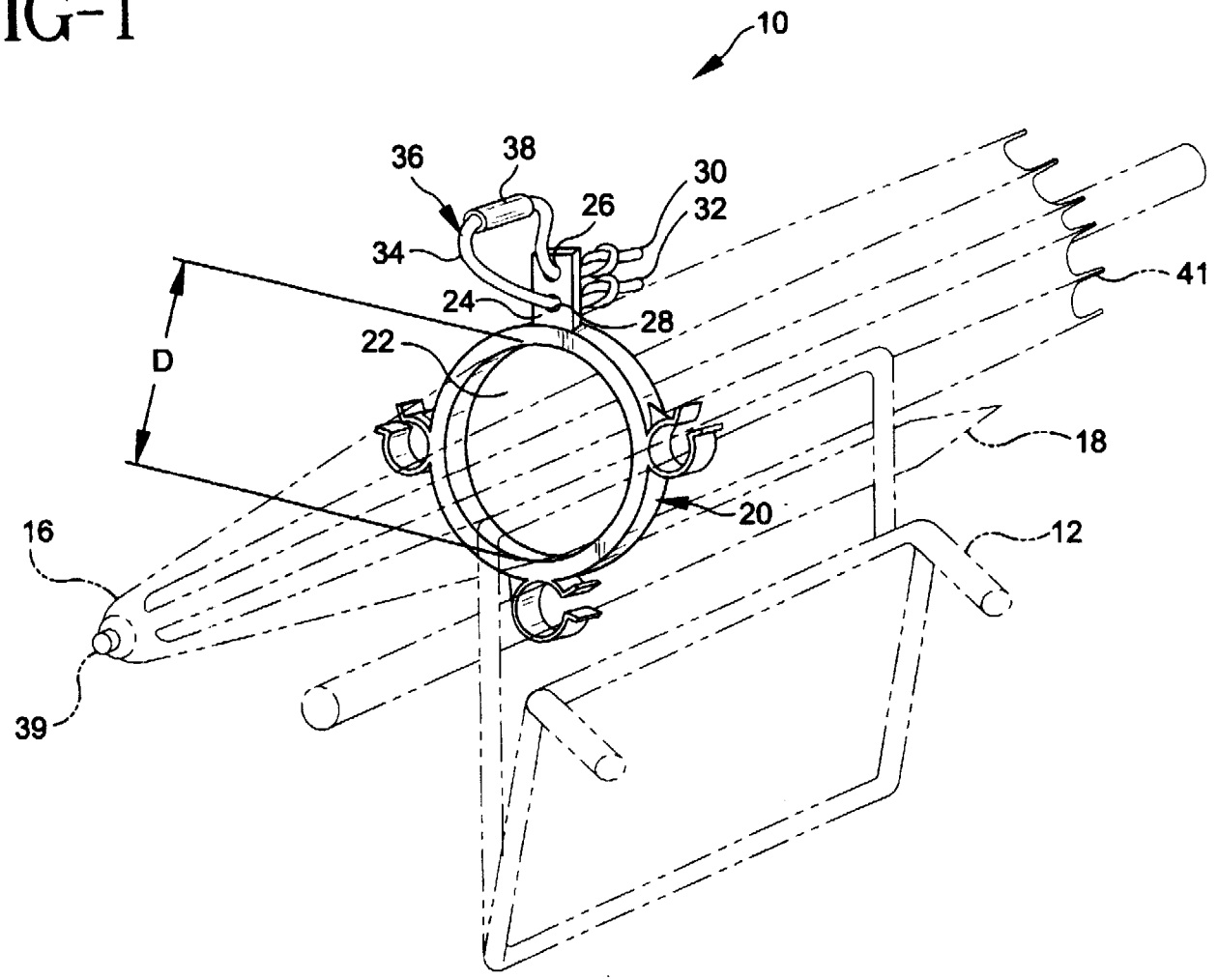
FIG. 1 is a perspective view of one preferred embodiment of the present invention tote device shown in conjunction with a beach umbrella, umbrella pole and a beach chair in order to illustrate the preferred use for the embodiment shown.

Referring to FIG. 1, there is shown an exemplary embodiment of the present invention tote device 10, shown supporting a beach chair 12, a beach umbrella 16 and a beach umbrella pole 18. Although only one beach chair is shown, it should be understood that two beach chairs can be carried, one on each side of the tote device 10. The tote device 10 is comprised of an annular structure 20 which defines a central opening 22 having a diameter D of between two inches and eight inches. A handle attachment element 24 extends from the annular structure 20 at the top or twelve o'clock position. The handle attachment element 24 is a rigid plate element that has two apertures 26, 28 formed through it. The free ends 30, 32 of a piece of rope 34, strapping or other flexible material are fed through the two apertures 26, 28. Once through the apertures 26, 28 the rope 34 is knotted into a configuration that can not pass through the apertures 26, 28. The hoop structure 36 formed by the rope 34 creates a grippable handle for carrying the tote device 10. To facilitate the easy gripping of the rope 34, an optional tubular element 38 can be passed over the rope 34, thereby providing a rigid gripping surface.

In the shown embodiment, the beach umbrella 16 is shown suspended within the annular structure 20 of the tote device 10. As is well known, when a beach umbrella is drawn closed, it forms a tapered structure that increases in diameter from its apex point 39 to its rim edge 41. When the umbrella 16 is closed, the apex point 39 of the umbrella 16 is passed through the annular structure 20 until the center of gravity for the umbrella 16 is positioned at a point generally in the plane of the annular structure 20. The inner diameter D of the annular structure 20 is preferably selected to partially compress the closed umbrella 16 into a more tightly closed configuration. The slight interference fit created by the contact between the annular structure 20 and umbrella 16 prevents the umbrella 16 from unintentionally falling out of the tote device 10 as it is being carried.

Figure 2:
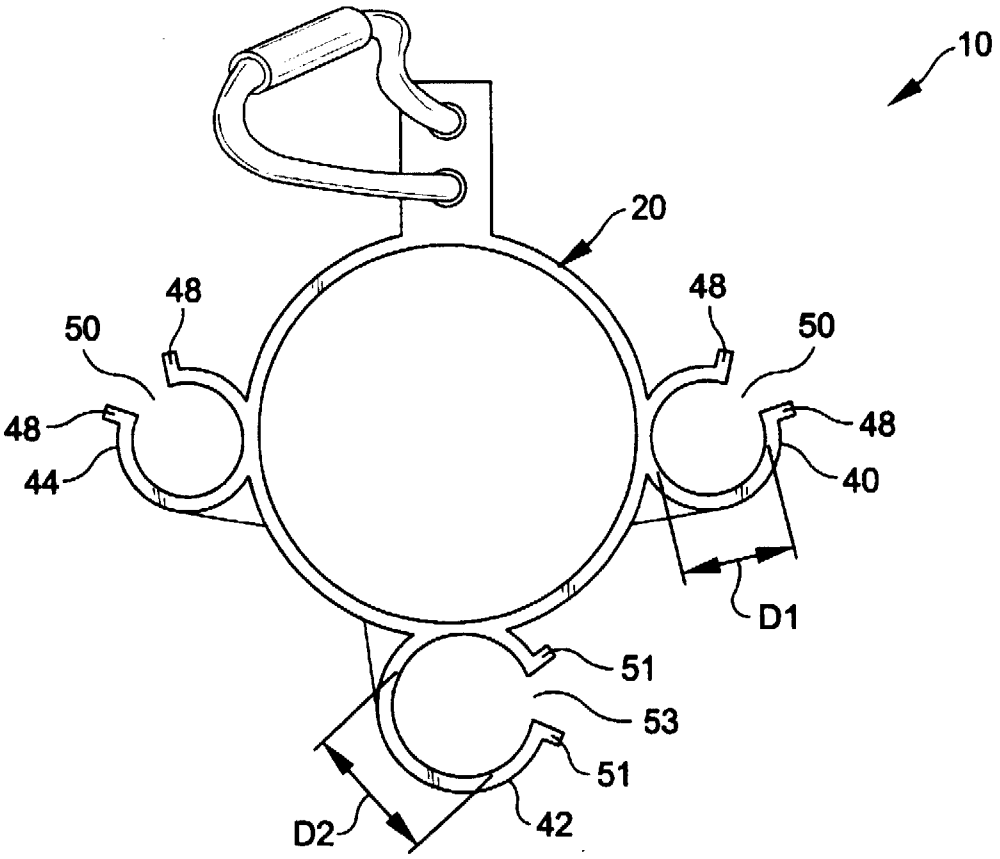
FIG. 2 is a front view of the embodiment of the tote device shown in FIG. 1.

Referring to FIG. 2 in conjunction with FIG. 1, it can be seen that a plurality of spring clamps 40, 42, 44 are radially disposed on the exterior of the annular structure 20. Although the location of the spring clamps 40, 42, 44 are shown in the three o'clock, six o'clock and nine o'clock positions, respectively, it should be understood that any multitude of spring clamps can be disposed at any points on the exterior of the annular structure 20.

In the shown embodiment of FIG. 2, the first side spring clamp 40, at the three o'clock position, and the opposite second side spring clamp 44, at the nine o'clock position, are identical in size, having an undeformed inner diameter D1 of between one half inch and two inches. The side spring clamps 40, 44 are preferably formed of a resilient material that allows the side spring clamps 40, 44 to be elastically deformed into larger diameters. Two guide tabs 48 are disposed on either side of an opening 50 on each of the side spring clamps 40, 44. The guide tabs 48 guide a cylindrical object into the side spring clamps 40, 44 by helping spread the opening 50 of the side spring clamps 40, 44. Since each side spring clamp 40, 44 has an undeformed interior diameter D1, the degree of flexibility designed into the material of the spring clamps 40, 44 and the size of the opening 50 are proportioned to enable an object as least as wide as the interior diameter D1 to pass into each side spring clamp 40, 44, without damaging the side spring clamps 40, 44.

The first side spring clamp 40 and the second side spring clamp 44 are sized to receive the aluminum tubing commonly associated with modern folding beach chairs. As is shown in FIG. 1, by placing the tubing of a beach chair into the first side spring clamp 40 and/or the second side spring clamp 44, one or two beach chairs can be engaged and carried by the tote device 10. The tubing of a beach chair is only one of many items capable of being engaged and supported by the side spring clamps 40, 44. Many items carried to the beach have structures that can be engaged by side spring clamps 40, 44. For instance, many baby products such as playpens and high chairs use tubular framing very similar to that of a folding beach chair. As a result, any such baby product can be carried by the tote device 10. Similarly, coolers often have side handles that include tubular cross elements. By suspending the handles of a cooler between two tote devices 10, a cooler can easily be carried along with many other items. Furthermore, most every type of bag has some sort of handle. Bag handles are typically hoops of material or molded plastic. The side spring clamps 40, 44 on the present invention tote device 10 act as hooks, wherein the side spring clamps 40, 44 are capable of retaining any handle capable of being passed into the openings 50 of the side spring clamps 40, 44.

As is shown by FIG. 2, the bottom spring clamp 42, at the six o'clock position on the annular structure 20, is similar in construction to the two side spring clamps 40, 44. However, in the preferred embodiment, the interior diameter D2 of the bottom spring clamp 42 is slightly larger than that of the two side spring clamps 40, 44. The interior diameter D2 of the bottom spring clamp 42 is preferably between one inch and two inches to provide a large enough space to receive large cylindrical objects such as umbrella poles, shovel handles, fishing pole handles and the like. The bottom spring clamp 42 also has guide tabs 51 disposed on either side of the clamp opening 53 to assist in the opening of the bottom spring clamp 42 as an object is passed into the bottom spring clamp 42.

In FIG. 1, an umbrella pole 18 is shown extending through the bottom spring clamp 42. The tubing used on many beach umbrella poles is wider than that used in typical folding beach chairs. As such, the narrow tube beach chair 12 are joined to the smaller side spring clamps 40, 44 and the wider tube umbrella pole 18 is joined to the larger bottom spring clamp 42.

Figure 3:
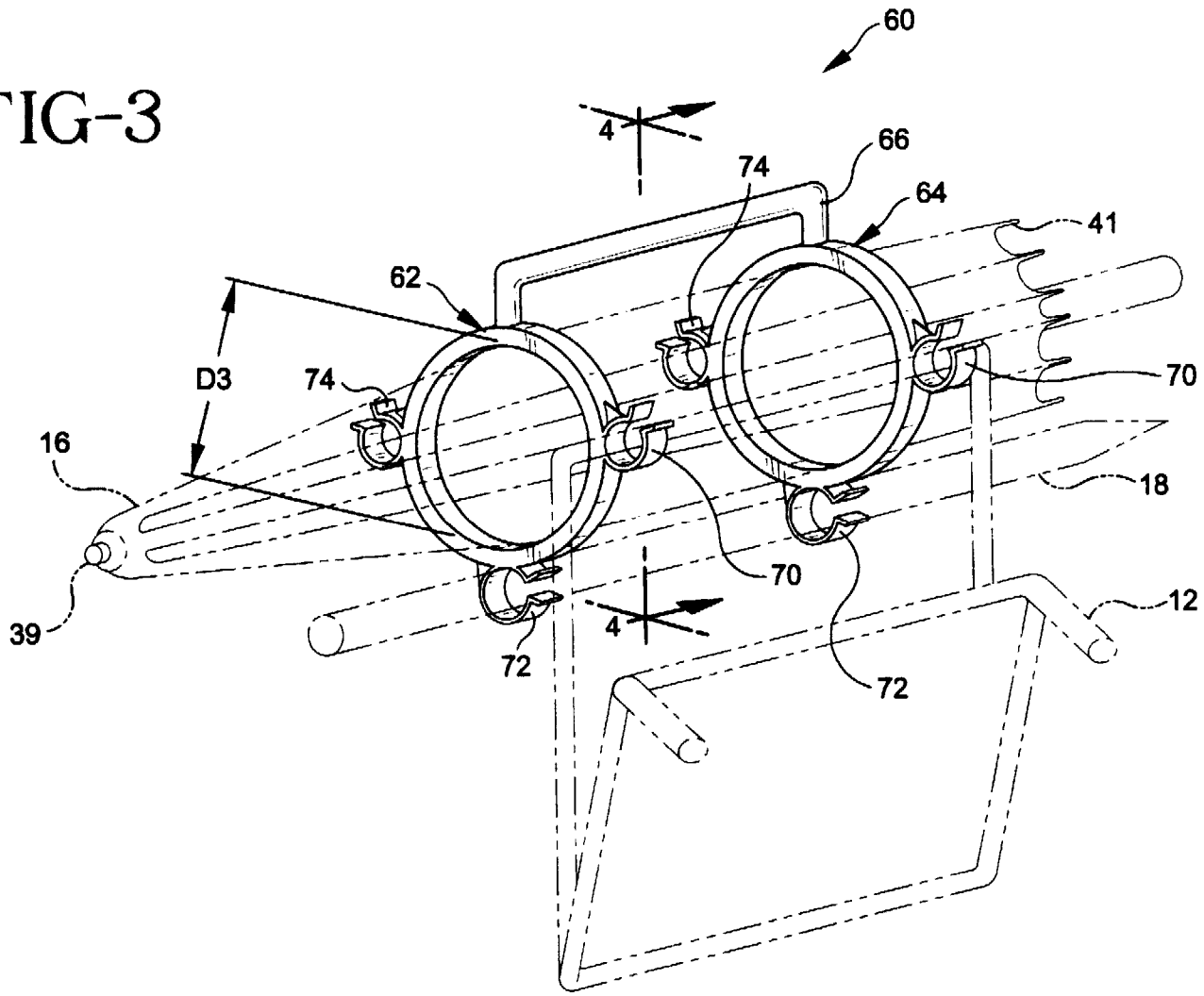
FIG. 3 is a perspective view of an alternate embodiment of the present invention tote device shown in conjunction with a beach umbrella, umbrella pole and a beach chair in order to illustrate the preferred use for the embodiment shown.

Referring to FIG. 3, a first alternate embodiment of the present invention tote device 60 is shown. The tote device 60 is comprised of two annular structures 62, 64 that are maintained in a concentric orientation by a handle element 66 that extends between the two annular structures 62, 64. The two annular structures 62, 64 are substantially identical in shape, wherein each defines a central opening having a diameter D3 of between two inches and eight inches. The handle element 66 engages each of the annular structures 62, 64 at the top or twelve o'clock position. The handle element 66 extends upwardly from each of the annular structures 62, 64 to provide enough clearance for a person to grip the handle element 66 without contacting the object being supported within the annular structures 62, 64.

In the shown embodiment, the beach umbrella 16 is shown suspended through the two annular structures 62, 64 of the tote device 60. When the umbrella 16 is closed, the apex point 39 of the umbrella 16 is passed through the two annular structures 20, 22 until the center of gravity for the umbrella 16 is positioned at a point generally between the two annular structures 62, 64. The inner diameter D3 of the annular structures 62, 64 is preferably selected to partially compress the closed umbrella 16 into a more tightly closed configuration. The slight interference fit created by the contact between the annular structures 62, 64 and umbrella 16 prevents the umbrella 16 from unintentionally falling out of the tote device 60 as it is being carried.

Figure 4:
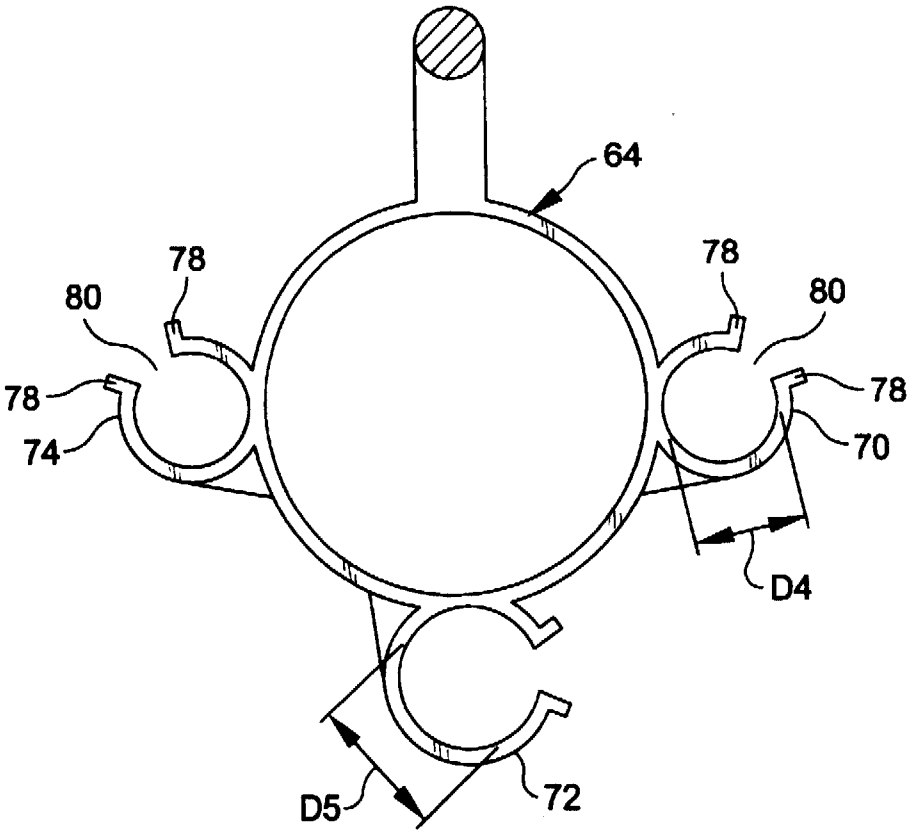
FIG. 4 is a cross-sectional view of the embodiment of the present invention tote device shown in FIG. 3, viewed along section line 4—4.

Referring to FIG. 4 in conjunction with FIG. 3, it can be seen that a plurality of spring clamps 70, 72, 74 are radially disposed on the exterior of the annular structures 62, 64. Although the locations of the spring clamps 70, 72, 74 are shown in the three o'clock, six o'clock and nine o'clock positions, respectively, it should be understood that any multitude of spring clamps can be disposed at any points on the exterior of the annular structures 62, 64. Regardless of the number or location of the spring clamps, the number and location of the spring clamps on each of the annular structures 62, 64 are the same. As a result, a spring clamp on the first annular structure 62 is always concentric with a corresponding spring clamp on the second annular structure 64.

In the shown embodiment of FIG. 4, the first side spring clamp 70, at the three o'clock position, and the opposite second side spring clamp 74, at the nine o'clock position, are identical in size, having an undeformed inner diameter D4 of between one half inch and two inches. The side spring clamps 70, 74 are preferably formed of a resilient material that allows the side spring clamps 70, 74 to be elastically deformed into larger diameters. Two guide tabs 78 are disposed on either side of an opening 80 on each of the side spring clamps 70, 74. The guide tabs 78 guide a cylindrical object into the side spring clamps 70, 74 by helping spread the opening 80 of the side spring clamps 70, 74. Since each side spring clamp 70, 74 has an undeformed interior diameter D4, the degree of flexibility designed into the material of the spring clamps 70, 74 and the size of the opening 80 are proportioned to enable an object as least as wide as the interior diameter D4 to pass into each side spring clamp 70, 74, without damaging the side spring clamps 70, 74.

The first side spring clamp 70 and the second side spring clamp 74 are sized to receive the aluminum tubing commonly associated with modern folding beach chairs. As is shown in FIG. 3, by placing the tubing of a beach chair into the first side spring clamp 70 and/or the second side spring clamp 74, across both the annular structures 62, 64, one or two beach chairs can be engaged and carried by the tote device.

As is shown by FIG. 4, the bottom spring clamp 72, at the six o'clock position on each of the annular structures 62, 64, is similar in construction to the two side spring clamps 70, 74. However, in the preferred embodiment, the interior diameter D5 of the bottom spring clamp 72 is slightly larger than that of the two side spring clamps 70, 74. The interior diameter D5 of the bottom spring clamp 72 is preferably between one inch and two inches to provide a large enough space to receive large cylindrical objects such as umbrella poles, shovel handles, fishing pole handles and the like. The bottom spring clamp 72 also has guide tabs 81 disposed on either side of the clamp opening 83 to assist in the opening of the bottom spring clamp 72 as an object is passed into the bottom spring clamp 72.

Figure 5:
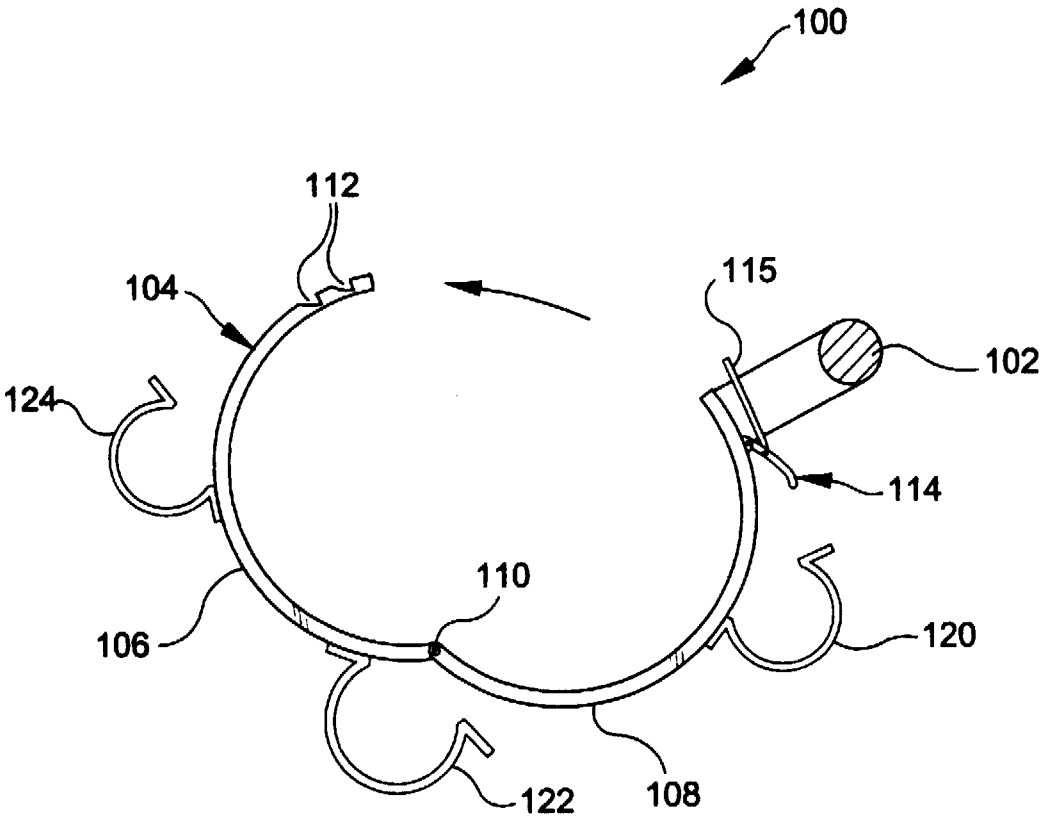
FIG. 5 is a cross-sectional view, viewed along the same section line as FIG. 4, of a second alternate embodiment of the present invention tote device.

Referring to FIG. 5, a cross-section of a second alternate embodiment of the present invention tote device 100 is shown. In this embodiment, two annular structures are present, joined together by a common handle element 102. This is the same structure as was shown in the previous embodiment as illustrated by FIG. 3. Each of the annular structures 104 is comprised of two semicircular elements 106, 108 that enable each of the annular structures 104 to be opened and closed. The two semicircular elements 106, 108, comprising each annular structure 104, are joined together at a pivot joint 110 located near the bottom of each annular structure 104. Latch grooves 112 are formed near the end of each first semicircular element 106, opposite the pivot joint 110. A latch assembly 114 is coupled to the end of each second semicircular element 108 opposite the pivot joint 110. The latch assembly 114 includes a hasp element 115 that engages the latch grooves 112 on the first semicircular element 106 and firmly biases the first semicircular element 106 against the second semicircular element 108 when the latch assembly 114 is tightened. The use of such latch assemblies is well known in a wide variety of arts.

By use of the latch assembly 114 and pivot joint 110 between the two semicircular elements 106, 108, it will be understood that each of the annular structures 104 can be selectively opened and closed. As a result, the annular structures 104 can be opened, an object such as an umbrella, skis or a bed roll can be placed into each annular structure 104, and then each annular structure 104 can be closed around the object.

In the alternate embodiment of FIG. 5, a different form of spring clamp is shown on the annular structures 104. In the embodiment of FIG. 5, the spring clamps 120, 122, 124 are comprised of convoluted spring elements coupled to the exterior of the first and second semicircular elements 106, 108, wherein the exteriors of the first and second semicircular elements 106, 108 themselves create part of the structure of each spring clamp 120, 122, 124.

It will be understood that the embodiments of the present invention illustrated and described are merely exemplary and many alternate embodiments of the present invention can be produced using functionally equivalent components to those described. For example, in the shown embodiments, either one or two annular structures are illustrated. The use of one or two annular structures is merely the best mode contemplated for the invention and it will be understood that one or any plurality of annular structures can be used in the formation of the present invention. Similarly, in the shown embodiments, circular shaped elements are used in forming the described annular elements. The use of circular shaped elements is also arbitrary and it should be understood that any other geometric shape could be used provided those shapes define an open central region. All such variations and modifications are intended to be included in the scope of the present invention as set forth in the appended claims.

What is claimed is:

1. A tote device, comprising:

at least one annular element concentrically aligned on a common axis, said at least one annular element having a top point, a bottom point, wherein said at least one annular element defines a circular opening;

a handle coupled to said at least one annular element at said top point; and at least one first spring clamp coupled to said at least one annular element between said top point and said bottom point, wherein said at least one first spring clamp is adapted to receive and retain a cylindrical object of a first predetermined diameter; and a second spring clamp coupled to said at least one annular element at said bottom point, wherein said second spring clamp is adapted to receive and retain a cylindrical object of a second predetermined diameter.

2. The tote device according to claim 1, wherein said at least one annular element includes a first annular element and a second annular element wherein said first annular element and said second annular element are coupled to each other by said handle.

3. The tote device according to claim 2, wherein both said first annular element and said second annular element define a circular opening that is generally uniform in size and said handle aligns said first annular element and said second annular so that each circular opening is concentrically disposed on said common axis.

4. The tote device according to claim 2, wherein said at least one first spring clamp includes a plurality of first spring clamps that are symmetrically disposed around each of said annular elements.

5. The tote device according to claim 4, wherein each of said plurality of first spring clamps on said first annular element is linearly aligned with a corresponding spring clamp on said second annular element.

6. The tote device according to claim 1, wherein said at least one first spring clamp includes a plurality of first spring clamps that are symmetrically disposed around said at least one annular element.

7. The tote device according to claim 1, wherein said at least one annular element is selectively openable between a first condition, where said at least one annular element is closed and an exterior surface thereof is continuous, and a second condition, where said at least one annular element is open and said exterior surface is not continuous.

8. The tote device according to claim 1, wherein said second predetermined diameter is larger than said first predetermined diameter.

9. A beach tote device capable of carrying a beach umbrella, an umbrella pole and at least two folding beach chairs, said tote device comprising:

at least one annular sleeve element concentrically disposed on a common axis, said at least one annular sleeve element having an exterior surface and defining an open central region sized to receive the beach umbrella therein;

at least two chair engagement clamps disposed on said exterior surface of said at least one annular sleeve element for selectively receiving at least two folding beach chairs, thereby coupling at least two folding beach chairs to said at least one annular sleeve element;

at least one pole engagement clamp disposed at the bottom most point on said exterior surface of said at least one annular sleeve element for selectively engaging the umbrella pole, thereby coupling the umbrella pole to said at least one annular sleeve element; and a handle coupled to the top of said at least one sleeve element, opposite said pole engagement clamp, thereby providing a means for carrying said at least one annular sleeve element.

10. The tote device according to claim 9, wherein said at least one annular sleeve element includes a first annular sleeve element and a second annular sleeve element, wherein said first annular sleeve element and said second annular sleeve element are coupled to each other by said handle.

11. The tote device according to claim 9, wherein said at least one annular sleeve element is selectively openable between an open condition and a closed condition.

* * * * *